United States Patent [19]

Shaw

[11] Patent Number: 4,877,252

[45] Date of Patent: Oct. 31, 1989

[54] GOLF BALLS

[75] Inventor: Michael Shaw, Wakefield, England

[73] Assignee: Dunlop Limited a British Company, United Kingdom

[21] Appl. No.: 260,069

[22] Filed: Oct. 20, 1988

[30] Foreign Application Priority Data

Nov. 3, 1987 [GB] United Kingdom ..... 8725685

[51] Int. Cl.[4] ..... A63B 37/14

[52] U.S. Cl. ..... 273/232; 273/213

[58] Field of Search ..... 273/232, 233, 235 R, 273/62, 213

[56] References Cited

U.S. PATENT DOCUMENTS 4,787,638 11/1988 Kobayashi ..... 273/232

FOREIGN PATENT DOCUMENTS 967188 5/1975 Canada ..... 273/232

*Primary Examiner*—George J. Marlo

*Attorney, Agent, or Firm*—Stevens, Davis, Miller & Mosher

[57] ABSTRACT

A golf ball (10) has a plurality of dimples in its outer surface. At least 10% of the dimples are so disposed relative to one another that any two adjacemt dimples overlap. The region of each overlap may have a maximum width of from 1% to 20% of the diameter of the larger of any two overlapping dimples. Preferably, the dimples are arranged in a repeating pattern over the whole surface of the ball. The pattern may be defined by projecting on to the ball the edges of a regular dodecahedron (11, 12, 13, 14, 15, 16, 17, 18, 19 and 20) so that the ball is notionally divided into twelve regular pentagons (one shown - 21).

10 Claims, 3 Drawing Sheets

GOLF BALLS

This invention relates to golf balls.

It is well known to provide golf balls with a plurality of dimples in the spherical surface of the ball and there have been many previous proposals to distribute those dimples in a repeating pattern. It is understood by those skilled in the relevant art that the dimple pattern, together with any non-dimpled areas, affects the playing characteristics of the ball. In particular, the flight path and flight distance of a golf ball, as well as the degree of air-resistance encountered during flight, can be greatly affected by the dimple pattern.

We have now found that the aforementioned playing characteristics can be considerably enhanced by so arranging the dimples on the surface of the ball that at least some adjacent dimples touch or overlap.

Accordingly, the present invention provides a golf ball having a plurality of dimples in its spherical outer surface, in which at least 10% of the dimples are so disposed relative to one another that the peripheries of any two adjacent dimples extend inside each other to form an overlapping region.

In a first aspect of the present invention, all the dimples are of equal diameter and the maximum width of the overlapping region is in the range 1% to 20% of the diameter of any one of the overlapping dimples.

In a second aspect, the dimples are of two or more different diameters and the maximum width of the overlapping region is in the range 1% to 20% calculated on the diameter of the larger of any two of the over-lapping dimples.

The golf balls of the present invention can have the dimples arranged in a repeating pattern over the whole spherical outer surface of the ball, the pattern being defined by projecting on to the ball surface the edge of a regular polyhedron. For example, the polyhedron may be: a cube (six square faces); an octahedron (eight rectangular faces); a dodecahedron (twelve pentagonal faces); an icosahedron (twenty triangular faces); or an icosidodecahedron (twelve pentagonal and twenty triangular faces).

The dimples may be circular in plan view and have a configuration which corresponds to that of a solid of revolution generated by rotation of a plane curve about a radius of the ball. Thus, the configuration of such dimples can be part-spherical, part-ellipsoid, conical or frusto-conical.

Alternatively, the dimples may be non-circular in plan view (e.g. triangular, rectangular or polygonal) and the dimple configuration may be, for example, tetrahedral, parallelepiped or pyramidal.

The pattern of a golf ball according to the present invention can be so arranged that when the ball is played, the dimple pattern will influence the axis of spin. Thus, it is possible to design the flight characteristics of such a ball to have a high degree of control and accuracy.

Although it is not intended that the present invention be construed according to any particular theory, it is believed that the touching or overlapping of the dimples reduces the effective diameter of the ball, thus reducing the "drag" encountered by the ball during flight. This reduction in "drag" has a corresponding beneficial effect on distance performance when the ball is played.

Two preferred embodiments of the present invention will be illustrated, merely by way of example, in the following description and with reference to the accompanying drawings.

Figure 2:
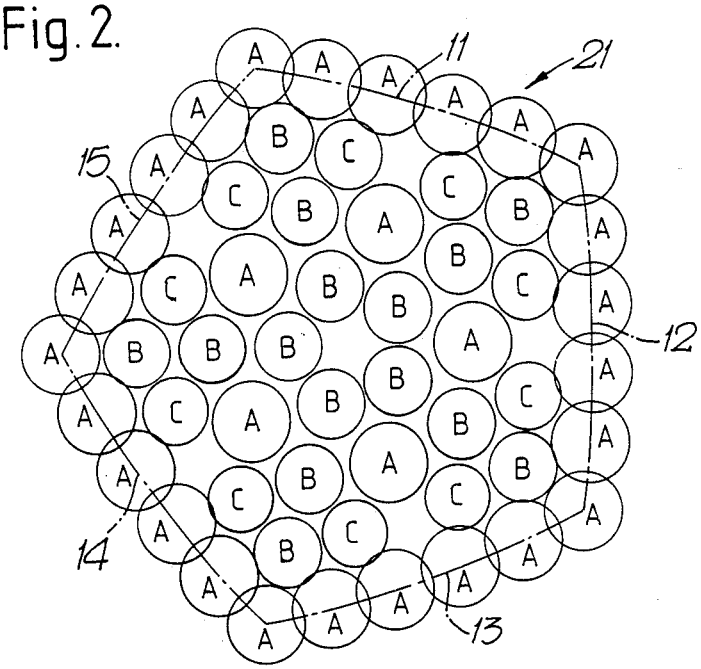
FIG. 2 is an enlarged view of a portion of the ball shown in FIG. 1.
Figure 4:
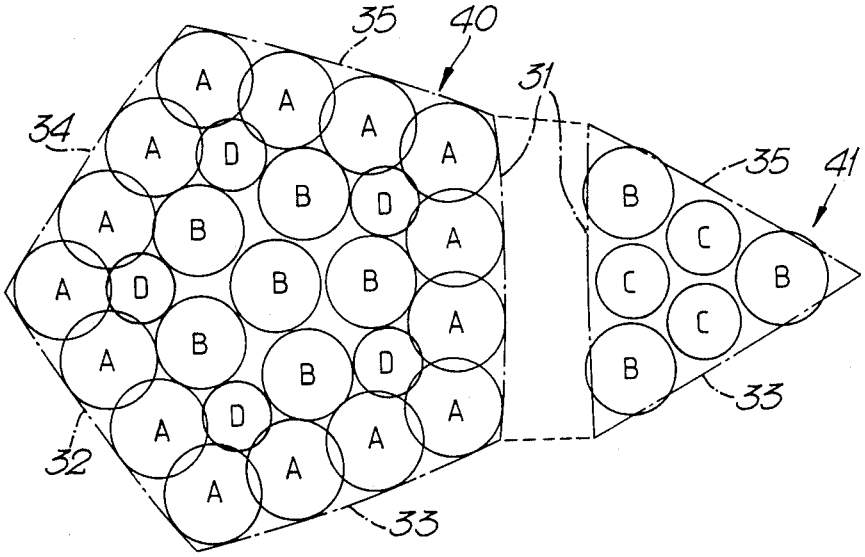
FIG. 4 is an enlarged view of a portion of the ball shown in FIG. 3.
Figure 3:
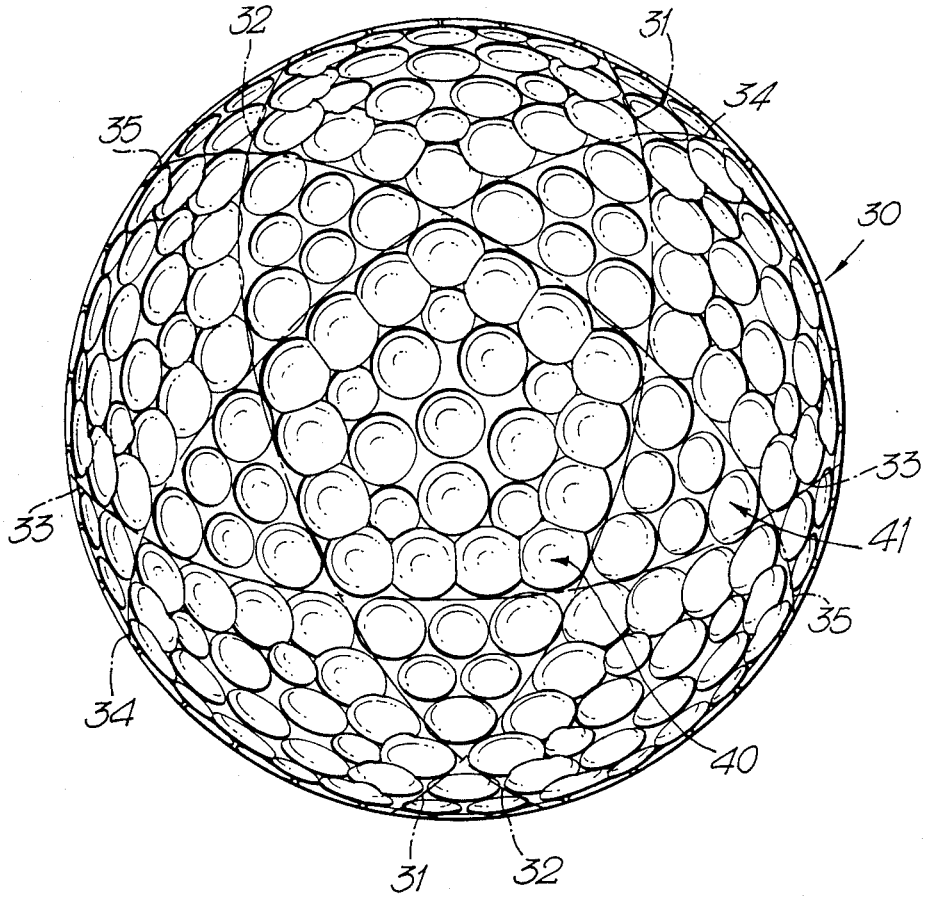
FIG. 3 is a perspective view of a golf ball according to a second preferred embodiment of the present invention.

In FIGS. 1 and 2, and again in FIGS. 3 and 4 of the drawings, like numerals denote like parts.

Figure 1:
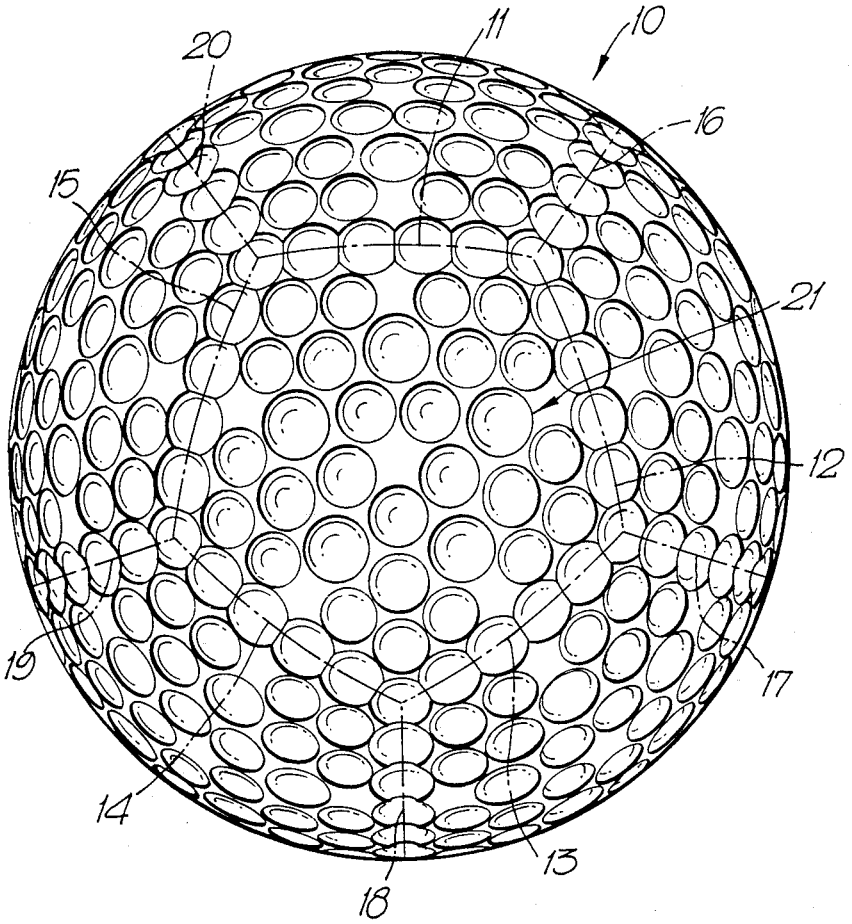
FIG. 1 is a perspective view of a golf ball according to a first preferred embodiment of the present invention.

In FIG. 1, a golf ball (indicated generally at 10) has a repeating dimple pattern indicated by chain-dotted lines 11, 12, 13, 14, 15, 16, 17, 18, 19 and 20. The said chain-dotted lines divide the spherical surface of the ball into twelve equal regular pentagons (one pentagon is indicated at 21 in FIG. 1).

In FIG. 2, pentagon 21 contains dimples of three different sizes, these being marked A, B and C respectively.

Several pairs of adjacent dimples in each pentagon overlap or touch as shown in the drawings. The ball illustrated in FIGS. 1 and 2 had the following dimple diameters:

A: 3.810 mm
B: 3.353 mm
C: 3.251 mm

The dimple pattern was dodecahedral and comprised twelve pentagons. The dimples numbered 500 in all and comprised:

200 of Diameter A
180 of Diameter B and
120 of Diameter C.

FIG. 3 shows a golf ball (indicated generally at 30) having a repeating dimple pattern indicated by chain-dotted lines 31, 32, 33, 34 and 35. (Lines 31, 32, 33, 34 and 35 represent five of the six "great circles" of the ball, the sixth "great circle" not being visible in the view shown in FIG. 3).

It will be seen that the "great circles" divide the spherical surface of the ball into a total of twelve pentagons and twenty triangles. In FIG. 3, one pentagon 40 and one triangle 41 is indicated.

Referring now to FIG. 4, pentagon 40 contains dimples of three different sizes, these being marked A, B and D respectively. Adjacent triangle 41 contains dimples of two different sizes, one of these sizes being marked B (as in pentagon 40) and the other being marked C. The several adjacent dimples overlap or touch as indicated in the drawings.

The ball illustrated in FIGS. 3 and 4 had the following dimple diameters:

A: 4.250 mm
B: 4.000 mm
C: 3.300 mm
D: 3.000 mm

The dimple pattern was icosidodecahredal and comprised twelve pentagons each containing 26 dimples (total 312) and twenty triangles each containing 6 dimples (total 120), making 432 dimples in all.

I claim:

1. A golf ball having in its spherical outer surface a plurality of dimples, wherein at least 10% of said dimples are so disposed relative to one another that any two of said dimples which are adjacent each other on said outer surface have peripheries which extend inside each other to form an overlapping region.

2. The golf ball of claim 1, wherein all said dimples are of equal diameter and the maximum width of said overlapping region is in the range 1% to 20% of the diameter of any one of said dimples.

3. The golf ball of claim 1, wherein said dimples are of two or more different diameters and the maximum width of said overlapping region is in the range 1% to 20% calculated on the diameter of the larger of any two of said overlapping dimples.

4. The golf ball of claim 1, wherein said dimples are arranged in a repeating pattern over the whole spherical outer surface of said ball, said pattern being defined by projecting on to said spherical outer surface the edges of a regular polyhedron.

5. The golf ball of claim 4, wherein said regular polyhedron is one selected from the group consisting of a cube, an octahedron, a dodecahedron, an icosahedron and an icosidodecahedron.

6. The golf ball of claim 1, wherein said dimples are of circular plan view.

7. The golf ball of claim 6, wherein said dimples have a configuration selected from the group consisting of part-spherical, part-ellipsoid, conical and frustoconical.

8. The golf ball of claim 1, wherein said dimples are of non-circular plan view.

9. The golf ball of claim 8, wherein said dimples have a plan view selected from the group consisting of triangular, rectangular and polygonal.

10. The golf ball of claim 9, wherein said dimples have a configuration selected from the group consisting of tetrahedral, parallelepiped and pyramidal.

* * * * *